United States Patent [19]

Justice

[11] Patent Number: 4,642,999

[45] Date of Patent: Feb. 17, 1987

[54] COOLER WITH CONTAINER CENTERING MEANS

[75] Inventor: James W. Justice, Indianapolis, Ind.

[73] Assignee: Pakway Container Corp., Indianapolis, Ind.

[21] Appl. No.: 829,182

[22] Filed: Feb. 13, 1986

[51] Int. Cl.[4] ..... F25D 11/00

[52] U.S. Cl. ..... 62/440; 62/457; 62/463; 62/464; 220/5 R; 220/902

[58] Field of Search ..... 62/457, 464, 459, 463, 62/400, 398; 220/94 A, 902, 903, 5 R; 222/146 C, 183

[56] References Cited

U.S. PATENT DOCUMENTS

| | | | |
|---|---|---|---|
| 4,042,142 | 8/1977 | Ruano | 62/400 X |
| 4,071,160 | 1/1978 | Vick | 220/5 R |
| 4,483,157 | 11/1984 | Human | 62/400 |

*Primary Examiner*—Lloyd L. King

*Attorney, Agent, or Firm*—Woodard, Weikart, Emhardt & Naughton

[57] ABSTRACT

A foamed polystyrene beverage container cooler. In one embodiment an annular wall is nestably received between a base and lid each of which defines a cylindrical inner cavity to receive a half barrel size beverage container. The outlet of the container extends centrally through an aperture located in the top wall of the lid locating the container concentrically with respect to the cylindrical inner surface of the cooler allowing ice to circumferentially surround the container. A skirt and rim mating combination between the annular wall and the lid and between the annular wall and the base secure the components together. In an alternate embodiment, a cooler to receive a pony keg includes a base and lid each of which has an annular wall defining a cavity sized to allow ice to surround the keg. The keg outlet extends through an aperture in the lid locating the keg concentrically with respect to the interior surface of the cooler. The lid has a downwardly extending skirt nestable within an upwardly extending rim integrally formed on the base.

10 Claims, 3 Drawing Figures

COOLER WITH CONTAINER CENTERING MEANS

BACKGROUND OF THE INVENTION

This invention is in the field of coolers and more specifically coolers produced from foamed plastic material. Beverages such as beer may be stored in relatively large containers which are relatively difficult to cool once the containers are transported to the dispensing location. Complex fabricated coolers are undesirable since the expense of such a cooler is too high to justify the use and possible discarding of same. Thus, many coolers have been provided produced from low cost materials. In many cases, such coolers did not provide sufficient insulation and will not control the amount of cooling medium surrounding the container. A variety of cooling devices have been provided for use with kegs of beer. For example, the keg may be placed within a bag or beneath a cover such as shown in the U.S. Pat. Nos. 3,443,397, issued to Donovan, et al. and 3,614,875 issued to McCallun. Rigid boxes or coolers for holding a keg in a horizontal position are shown in the U.S. Pat. Nos. 3,315,491 issued to Zant, 3,627,399 issued to Addison, et al., 3,315,846 issued to Landis, et al., and 3,789,622 issued to Yanes. Coolers have also been provided for holding the beer keg in a housing having ice therein such as shown in the U.S. Pat. Nos. 2,159,729 issued to Ribble and 3,790,032 issued to George.

Despite the prior coolers, it is still the practice to place a keg of beer in a large open topped metal container and to then fill the container with ice. A heavy tarpaulin or canvas is then typically draped across the container for insulation purposes. This type of arrangement is both unsightly and very difficult to move and set-up. Disclosed herein is a cooler produced from foam polystyrene which is low cost and light weight. The cooler may be reused or disgarded due to its low cost after a single use. Further, the cooler provides a tidy and attractive appearance. The construction of the cooler is such that the cooler may be shipped and stored with minimum space requirements. The cooler is assembled in such a manner to allow the keg to be lifted a minimum vertical distance for installation in the cooler with centering means provided locating the keg with respect to the cooler insuring ice is positioned completely around the keg side wall.

SUMMARY OF THE INVENTION

One embodiment of the present invention is a beer barrel cooler comprising a plastic foam produced lid having a horizontally extending top wall with a aperture extending therethrough to receive a beer barrel outlet, the lid having a first annular wall depending from and integrally attached to the top wall with the annular wall having a first outer surface and a first inner surface with the inner surface having an interior diameter of a size to allow the lid to be placed around a beer barrel with space between the annular wall and the barrel, the aperture being located centrally in the top wall to locate the beer barrel concentric within the annular wall allowing ice to occupy the space and completely circumferentially around the beer barrel, the annular wall including a bottom end with a continuous cylindrically extending first skirt integrally attached thereto, a plastic foam produced middle ring having a second annular wall with the second annular wall having a second outer surface and a second inner surface with the second inner surface having an interior diameter of a size to allow the second wall to be placed around the beer barrel with second space therebetween, the second wall including a bottom end with a continuous cylindrically extending second skirt integrally attached thereto, the second wall including a top end of reduced thickness forming an upwardly extending first rim and an upwardly facing first ledge with the first skirt fitting matingly with respect to the rim and resting atop the ledge locating the beer barrel concentric within the ring allowing ice to occupy the second space and completely circumferentially around the beer barrel, and, a plastic foam produced base having a horizontally extending bottom wall upon which the beer barrel may rest, the base having a third annular wall extending upwardly from and integrally attached to the bottom wall with the third annular wall having an third outer surface and an third inner surface with the third inner surface having an interior diameter of a size to allow the beer barrel to rest therein atop the bottom wall with third space between the barrel and the third annular wall, the base including a top end of reduced thickness forming an upwardly extending second rim and an upwardly facing second ledge with the second skirt fitting matingly with respect to the second rim and resting atop the second ledge locating the beer barrel concentric within the base allowing ice to occupy the third space and completely circumferentially around the beer barrel.

A further embodiment of the present invention is the combination of an upstanding beer barrel with a vertical longitudinal axis and an outlet extending vertically upward therefrom, the barrel having a circular cross section along the length of the vertical longitudinal axis, a plastic foam produced lid having a horizontally extending top wall with a aperture extending therethrough to receive the outlet, the lid having a first annular wall depending from and integrally attached to the top wall with the annular wall having a first outer surface and a first inner surface with the inner surface having an interior diameter of a size to allow the lid to be placed around the beer barrel with space between the annular wall and the barrel, the aperture being located in the top wall to locate the beer barrel concentric within the annular wall allowing ice to occupy the space and completely circumferentially around the beer barrel, the annular wall including a bottom end with a continuous cylindrically extending first skirt integrally attached thereto, a plastic foam produced middle ring having a second annular wall with the second annular wall having a second outer surface and a second inner surface with the second inner surface having an interior diameter of a size to allow the second wall to be placed around the beer barrel with second space therebetween, the second wall including a bottom end with a continuous cylindrically extending second skirt integrally attached thereto, the second wall including a top end of reduced thickness forming an upwardly extending first rim and an upwardly facing first ledge with the first skirt fitting matingly with respect to the rim and resting atop the ledge locating the beer barrel concentric within the ring allowing ice to occupy the second space and completely circumferentially around the beer barrel, and, a plastic foam produced base having a horizontally extending bottom wall upon which the beer barrel may rest, the base having a third annular wall extending upwardly from and integrally attached to the bottom wall with the third annular wall having an third outer surface and an third inner surface with the third inner surface having an interior diameter of a size to allow the beer barrel to rest therein atop the bottom wall with third space between the barrel and the third annular wall, the base including a top end of reduced thickness forming an upwardly extending second rim and an upwardly facing second ledge with the second skirt fitting matingly with respect to the rim and resting atop the second ledge locating the beer barrel concentric within the base allowing ice to occupy the third space and completely circumferentially around the beer barrel.

Yet another embodiment of the present invention is a cooler for holding a container of liquid comprising a plastic foam produced lid having a horizontally extending top wall with a aperture extending therethrough to receive a container outlet, the lid having an first annular wall depending from and integrally attached to the top wall with the annular wall having a first outer surface and a first inner surface with the inner surface having an interior diameter of a size to allow the lid to be placed around a container with space between the annular wall and the container, the aperture being located in the top wall to locate the container concentric within the annular wall allowing ice to occupy the space and completely circumferentially around the container, the annular wall including a bottom end with a continuous cylindrically extending skirt integrally attached thereto, a plastic foam produced base having a horizontally extending bottom wall upon which the container may rest, the base having a second annular wall extending upwardly from and integrally attached to the bottom wall with the second annular wall having an second outer surface and an second inner surface with the second inner surface having an interior diameter of a size to allow the container to rest therein atop the bottom wall with second space between the container and the second annular wall, the base including a top end of reduced thickness forming an upwardly extending rim and an upwardly facing ledge with the skirt fitting matingly with respect to the rim and resting atop the ledge locating the container concentric within the base allowing ice to occupy the second space and completely circumferentially around the container.

It is an object of the present invention to provide a new and improved beer barrel cooler.

Yet another object of the present invention is to provide a device for cooling a beverage container with the device being low coat, light weight, and disposable.

In addition, it is an object of the present invention to provide a beer barrel cooler having a tidy and clean appearance.

In addition, it is an object of the present invention to provide a device for cooling a beverage container including means for centering the container with respect to the device insuring that ice surrounds the container sidewall.

Related objects and advantages of the present invention will be apparent from the following description.

DESCRIPTION OF THE PREFERRED EMBODIMENTS

Figure 1:
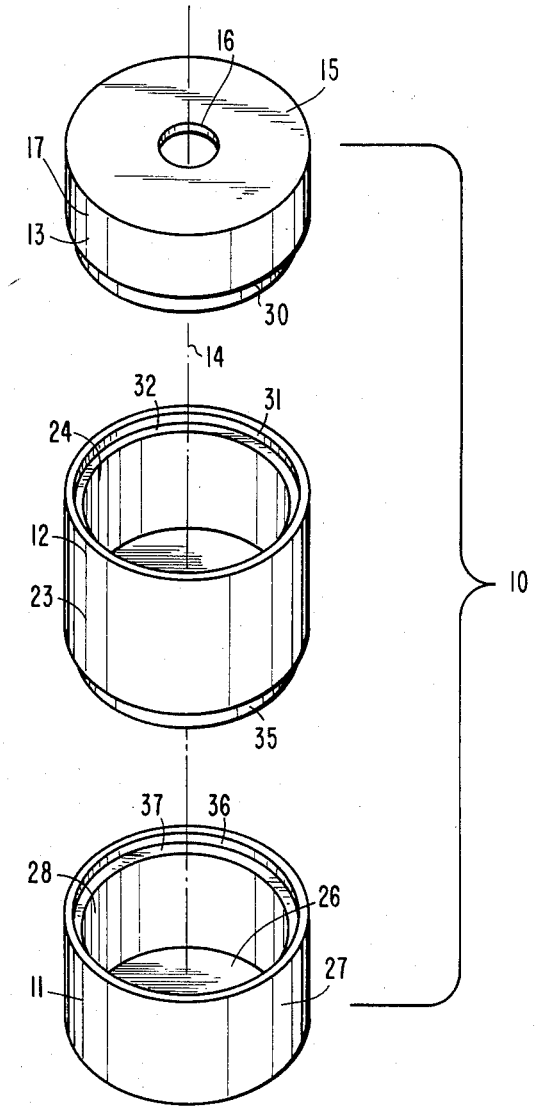
FIG. 1 is an exploded perspective view of the preferred embodiment of the cooler incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a cooler 10 incorporating the present invention having a base 11 nestably receiving a middle ring 12 in turn nestably receiving a lid 13. All three components are produced from a plastic foam material such as expandable polystyrene and have a longitudinal axis 14 extending centrally therethrough.

Figure 2:
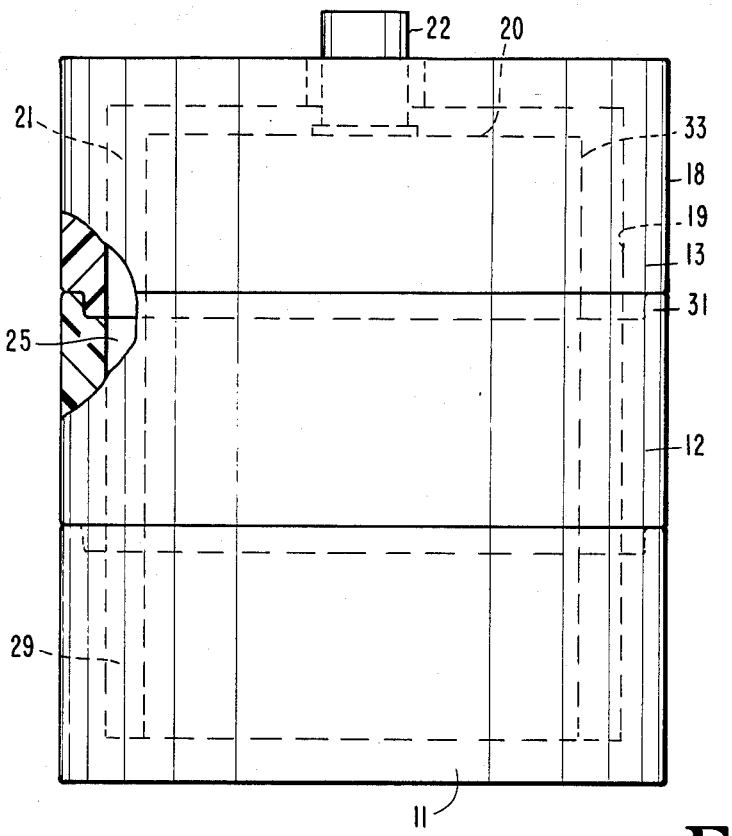
FIG. 2 is an enlarged fragmentary side view of the cooler of FIG. 1 shown in the assembled state having a beverage container therein.

Lid 13 has a horizontally extending top wall 15 with an aperture 16 extending therethrough and centrally located thereon. A continuous annular side wall 17 depends from and is integrally attached to top wall 16 and has an outer cylindrical surface 18 along with an inner cylindrical surface 19 (FIG. 2). The inside diameter of wall 17 which is the diameter of surface 19 is of a size to allow the lid to be placed around the top portion of a container such as a beer barrel 20 allowing sufficient space 21 extending completely around barrel 20 between the barrel and surface 19 to accommodate ice. Aperture 16 being centrally located receives the centrally located outlet pipe 22 of barrel 20 thereby centrally locating the barrel with respect to wall 17 and insuring sufficient space for the ice to extend completely around the barrel.

Ring 12 has an annular main body also with an outer cylindrical surface 23 and inner cylindrical surface 24 with the inside diameter of surface 24 being equal to the inside diameter of cylindrical inner surface 19. Thus, an annular interior space 25 is provided between barrel 20 and inner surface 24.

The base 11 includes a horizontally extending bottom wall 26 integrally attached to cylindrical side wall 27 extending upwardly therefrom. The interior diameter of the inner surface 28 of side wall 27 is equal to the interior diameter of surface 24 thereby providing a third annular interior space 29 for the location of the ice surrounding the barrel. The lid, ring and base are removably secured together by means of downwardly extending skirts and upwardly extending mating rims. Lid 13 includes a continuous circumferentially extending skirt 30 which is located inwardly of the outer surface 18 forming an outwardly facing recess. The top end of ring 12 is of reduced thickness forming an upwardly extending rim 31 of an inside diameter equal to or slightly greater than the outside diameter of skirt 30 thereby allowing the skirt to nest within the rim. Rim 31 has an outer surface the same as surface 23 whereas the inner surface of the rim is indented forming an upwardly facing ledge 32 upon which skirt 30 rests when fully seated within the rim. Thus, once outlet pipe 22 extends through aperture 16, the outer surface of the side wall 33 of barrel 20 is located concentric with respect to surface 19 with the rim and skirt arrangement also locating surface 33 concentric with respect to the inner surface 24 of ring 12 insuring ice placed within the cooler occupies spaces 21 and 25 and extends completely around the vertical side wall or surface 33 of the barrel. Similarly, ring 12 has a bottom end with a continuous cylindrically extending skirt 35 integrally attached thereto. Skirt 35 is located inwardly of surface 23 forming an outwardly facing recess. The top end of base 11 is of reduced thickness forming an upwardly extending rim 36 having an outer surface the same as outer surface 27 but with a recessed inner surface forming an upwardly facing ledge 37. Rim 36 has an inside diameter equal to or slightly greater than the outside diameter of skirt 35 thereby allowing the skirt to be nested within rim 36 and atop ledge 37 securing the ring and base together. Rim 36 and skirt 35 thereby centrally located the base relative to the outside surface 33 of barrel 20 allowing space 29 to extend completely around the barrel to insure that ice within space 29 surrounds the barrel.

Rims 31 and 36 are locaed on outer surfaces 23 aNd 27, respectively, with the associated ledges 32 and 37 being located inwardly and downwardly from rims 31 and 36, respectively. Thus, any melting ice or liquid is required in order to escape the cooler to flow outwardly in a horizotnal direction atop ledges 32 and 37 and then vertically upward and again horizontally outward atop rims 31 and 36. It is believed that superior leak resistance is thereby achieved.

In one version of the embodiment of FIG. 2, the diameter of aperture 16 is five inches as compared to the four inch diameter of the barrel outlet pipe 22. Barrel 20 has a cylindrical configuration with an outside diameter of surface 33 being approximately four inches less than the inside diameter of the cooler. The lid, ring and base in the same version have equal vertical heights. For example, the height from the top of wall 15 to the bottom edge of skirt 30 is ten inches, the height of ring 12 from the top edge of rim 31 to the bottom edge of skirt 35 is ten inches and the height of base 11 from the top of rim 36 to the bottom surface of the base is ten inches. The inside diameter of the cooler depicted in FIG. 2 is nineteen inches whereas the outside diameter of barrel 20 is approximately 15 inches. The cooler is designed to hold the barrel in an upright position so that the longitudinal axis of the barrel extends vertically. When assembling the base, ring and lid to the barrel, the ring and lid are first removed from the base and the barrel is lifted upwardly and seated into the base. Due to the relatively small height of the base, as compared to the overall height of the cooler, the barrel must be lifted up a relatively short distance. Once the barrel is centered within the base, the ring is slipped around the barrel and mounted to the base. Ice is then poured into the ring occupying interior space 25 and 29. The lid is then installed over the barrel and ice is poured into space 21 through any remaining gap between outlet pipe 22 and the outer edge of aperture 16 or the cooler may be temporarily tilted at a 45° angle and the lid pulled slightly away from the ring 12 allowing the ice to be poured into space 21. In the latter case, the lid must be tilted with respect to the ring to insure that the ice does not fall out through the bottom junction of the lid and ring. Outlet 22 extending through the top wall aperture insures that the barrel will remain centrally located within the cooler also insuring that ice or melted ice will always circumferentially surround the barrel due to the existence of spaces 21, 25 and 29.

Figure 3:
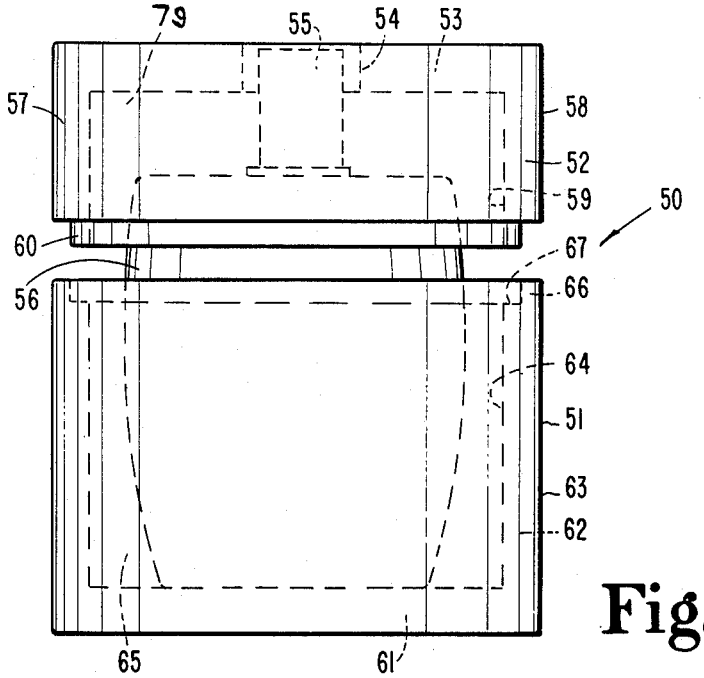
FIG. 3 is an exploded side view of an alternate embodiment of the cooler of the present invention with a beverage container shown positioned therein.

Cooler 10 is designed to receive a beverage container such as a half barrel of beer whereas the alternate embodiment of the cooler depicted in FIG. 3 is sized and configured to receive a smaller beverage container such as a pony keg of beer. Cooler 50 is identical with respect to cooler 10 with the exception that cooler 50 is not provided with a ring 12 and with the exception that the base 51 and lid 52 are downsized to receive the smaller beverage container. Lid 52 has a horizontally extending top wall 53 with a five inch aperture 54 extending centrally therethrough to receive the outlet pipe 55 of keg 56. Lid 52 has an annular wall 57 depending from and integrally attached to top wall 53. The annular wall includes an outer surface 58 and an inner cylindrical surface 59 having an interior diameter of a size to allow the lid to be placed around keg 56 thereby forming an interior ice receiving space 79. The bottom edge of annular wall 57 includes a continuous cylindrically extending skirt 60 integrally attached thereto which is recessed from the outer surface 58 forming an annular recess to receive the upwardly extending rim 66 of base 51.

The base has a horizontally extending bottom wall 61 upon which keg 56 may rest. An annular wall 62 extends upwardly from and is integrally attached to bottom wall 61. Wall 62 has an outer surface 63 and an inner surface 64 defined by an inside diameter larger than keg 56 to insure sufficient space 65 exists between the side wall and keg for the ice to occupy. The top end of wall 63 is of reduced thickness forming rim 66 having an outer surface the same as outer surface 63 but with the inner surface of the rim recessed forming an upwardly facing ledge 67 upon which skirt 60 may rest. The inside diameter of rim 66 is slightly larger or equal to the outside diameter of skirt 60 which is fitted matingly into the rim. The upwardly extending and centrally located outlet pipe 55 of the keg extends through aperture 54 locating the container concentrically with respect to the interior surfaces 64 and 59 of the base and lid, respectively. The rim and skirt mating arrangement insures that surfaces 59 and 64 are aligned allowing the ice to occupy at all times spaces 79 and 65.

To install the keg into cooler 50, the lid is removed from the base and the keg is lifted upwardly and into the base. The keg is located approximately centrally with respect to the interior surface 64 with ice then being poured into a space 65 and the lid then installed onto the keg and base. Additional ice may be poured through aperture 54 or cooler 50 may be tilted immediately prior to nesting the skirt into the rim and the ice poured therebetween and into space 79.

Skirt 60 is located inwardly of the outer surface of the lid thereby necessitating any escape of melted ice to flow first horizontally outward atop ledge 67 and vertically upward and again horizontally outward atop rim 66.

In one version of cooler 50 aperture 54 has a five inch diameter with outlet pipe 55 having approximately a four inch diameter. The inside diameter of the cooler defined by spaces 79 and 64 is seventeen inches as compared to the maximum outside diameter of keg 56 of approximately eleven inches. The height of the lid of cooler 50 from the top of the lid to the bottom edge of the skirt is seven inches whereas the height of the base from the bottom surface thereof to the top edge of the rim is fourteen inches.

In both embodiments of the cooler depicted in the drawings, the foam polystyrene has a final density of two pounds per cubic foot. The base ring, and lid of the cooler depicted in FIG. 1 have equal heights allowing for all three components to be simultaneously formed in a mold. Three separate mold cavities having equal depths as a result of the equal heights of the components enable equal heating of the foam polystyrene providing a uniform appearance of the solidified material in each base, ring and lid simultaneously produced. In the versions described herein, cooler 10 will receive approximately 24 pounds of ice with a conventionally sized half barrel container installed in the cooler, whereas cooler 50 will accept approximately 32 pounds of ice with a conventional size pony keg located therein.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A beer barrel cooler comprising:

a plastic foam produced lid having a horizontally extending top wall with a aperture extending therethrough to receive a beer barrel outlet, said lid having a first annular wall depending from and integrally attached to said top wall with said annular wall having a first outer surface and a first inner surface with said inner surface having an interior diameter of a size to allow said lid to be placed around a beer barrel with space between said annular wall and said barrel, said aperture being located centrally in said top wall to locate said beer barrel concentric within said annular wall allowing ice to occupy said space and extend completely circumferentially around said beer barrel, said annular wall including a bottom end with a continuous cylindrically extending first skirt integrally attached thereto;

a plastic foam produced middle ring having a second annular wall with said second annular wall having a second outer surface and a second inner surface with said second inner surface having an interior diameter of a size to allow said second wall to be placed around said beer barrel with second space therebetween, said second wall including a bottom end with a continuous cylindrically extending second skirt integrally attached thereto, said second wall including a top end of reduced thickness forming an upwardly extending first rim and an upwardly facing first ledge with said first skirt fitting matingly with respect to said rim and resting atop said ledge locating said beer barrel concentric within said ring allowing ice to occupy said second space and extend completely circumferentially around said beer barrel; and, a plastic foam produced base having a horizontally extending bottom wall upon which said beer barrel may rest, said base having a third annular wall extending upwardly from and integrally attached to said bottom wall with said third annular wall having an third outer surface and an third inner surface with said third inner surface having an interior diameter of a size to allow said beer barrel to rest therein atop said bottom wall with third space between said barrel and said third annular wall, said base including a top end of reduced thickness forming an upwardly extending second rim and an upwardly facing second ledge with said second skirt fitting matingly with respect to said second rim and resting atop said second ledge locating said beer barrel concentric within said base allowing ice to occupy said third space and extend completely circumferentially around said beer barrel.

2. The cooler of claim 1 wherein:

said first skirt is located inwardly of said first outer surface forming an outwardly facing first recess, said first rim is located on said second outer surface with said first ledge located inwardly and downwardly therefrom directing any melted ice to flow outwardly between said lid and said ring in a horizontal direction and then vertically up and further outward in a horizontal direction; and, said second skirt is located inwardly of said second outer surface forming an outwardly facing second recess, said second rim is located on said third outer surface with said second ledge located inwardly and downwardly therefrom directing any melted ice to flow outwardly between said ring and said base in a horizontal direction and then vertically up and further outward in a horizontal direction.

3. The cooler of claim 2 wherein:

said lid, said ring and said base have equal vertical heights.

4. The combination of:

an upstanding beer barrel with a vertical longitudinal axis and an outlet extending vertically upward therefrom, said barrel having a circular cross section along the length of said vertical longitudinal axis;

a plastic foam produced lid having a horizontally extending top wall with a aperture extending therethrough to receive said outlet, said lid having a first annular wall depending from and integrally attached to said top wall with said annular wall having a first outer surface and a first inner surface with said inner surface having an interior diameter of a size to allow said lid to be placed around said beer barrel with space between said annular wall and said barrel, said aperture being located in said top wall to locate said beer barrel concentric within said annular wall allowing ice to occupy said space and extend completely circumferentially around said beer barrel, said annular wall including a bottom end with a continuous cylindrically extending first skirt integrally attached thereto;

a plastic foam produced middle ring having a second annular wall with said second annular wall having a second outer surface and a second inner surface with said second inner surface having an interior diameter of a size to allow said second wall to be placed around said beer barrel with second space therebetween, said second wall including a bottom end with a continuous cylindrically extending second skirt integrally attached thereto, said second wall including a top end of reduced thickness forming an upwardly extending first rim and an upwardly facing first ledge with said first skirt fitting matingly with respect to said rim and resting atop said ledge locating said beer barrel concentric within said ring allowing ice to occupy said second space and extend completely circumferentially around said beer barrel; and, a plastic foam produced base having a horizontally extending bottom wall upon which said beer barrel may rest, said base having a third annular wall extending upwardly from and integrally attached to said bottom wall with said third annular wall having an third outer surface and an third inner surface with said third inner surface having an interior diameter of a size to allow said beer barrel to rest therein atop said bottom wall with third space between said barrel and said third annular wall, said base including a top end of reduced thickness forming an upwardly extending second rim and an upwardly facing second ledge with said second skirt fitting matingly with respect to said second rim and resting atop said second ledge locating said beer barrel concentric within said base allowing ice to occupy said third space and extend completely circumferentially around said beer barrel.

5. The combination of claim 4 wherein:

said aperture is located centrally in said top wall.

6. The combination of claim 5 wherein:

said first skirt is located inwardly of said first outer surface forming an outwardly facing first recess, said first rim is located on said second outer surface with said first ledge located inwardly and downwardly therefrom directing any melted ice to flow outwardly between said lid and said ring in a horizontal direction and then vertically up and further outward in a horizontal direction; and, said second skirt is located inwardly of said second outer surface forming an outwardly facing second recess, said second rim is located on said third outer surface with said second ledge located inwardly and downwardly therefrom directing any melted ice to flow outwardly between said ring and said base in a horizontal direction and then vertically up and further outward in a horizontal direction.

7. The cooler of claim 6 wherein:

said lid, said ring and said base have equal vertical heights.

8. A cooler for holding a container of liquid comprising:

a plastic foam produced lid having a horizontally extending top wall with a aperture extending therethrough to receive a container outlet, said lid having an first annular wall depending from and integrally attached to said top wall with said annular wall having a first outer surface and a first inner surface with said inner surface having an interior diameter of a size to allow said lid to be placed around a container with space between said annular wall and said container, said aperture being located in said top wall to locate said container concentric within said annular wall allowing ice to occupy said space and completely circumferentially around said container, said annular wall including a bottom end with a continuous cylindrically extending skirt integrally attached thereto;

a plastic foam produced base having a horizontally extending bottom wall upon which said container may rest, said base having a second annular wall extending upwardly from and integrally attached to said bottom wall with said second annular wall having an second outer surface and an second inner surface with said second inner surface having an interior diameter of a size to allow said container to rest therein atop said bottom wall with second space between said container and said second annular wall, said base including a top end of reduced thickness forming an upwardly extending rim and an upwardly facing ledge with said skirt fitting matingly with respect to said rim and resting atop said ledge locating said container concentric within said base allowing ice to occupy said second space and completely circumferentially around said container.

9. The cooler of claim 8 wherein:

said aperture is located centrally in said top wall.

10. The cooler of claim 8 wherein:

said skirt is located inwardly of said first outer surface forming an outwardly facing first recess, said rim is located on said second outer surface with said ledge located inwardly and downwardly therefrom directing any melted ice to flow outwardly between said lid and said base in a horizontal direction and then vertically up and further outward in a horizontal direction.

* * * * *